US008899293B2

(12) United States Patent
Suhara et al.

(10) Patent No.: US 8,899,293 B2
(45) Date of Patent: Dec. 2, 2014

(54) COMPONENT MOUNTING MACHINE

(75) Inventors: Shinsuke Suhara, Kariya (JP); Hiroshi Katsumi, Chiryu (JP); Noriaki Iwaki, Hekinan (JP); Masaki Murai, Nishio (JP)

(73) Assignee: Fuji Machine Mfg. Co., Ltd., Chiryu-shi (JP)

( * ) Notice: Subject to any disclaimer, the term of this patent is extended or adjusted under 35 U.S.C. 154(b) by 494 days.

(21) Appl. No.: 13/281,914

(22) Filed: Oct. 26, 2011

(65) Prior Publication Data

US 2012/0111505 A1 May 10, 2012

(30) Foreign Application Priority Data

Nov. 4, 2010 (JP) ..... 2010-247568

(51) Int. Cl.

| | |
|---|---|
| ***B26D 7/06*** | (2006.01) |
| ***B29C 65/50*** | (2006.01) |
| ***B65H 37/00*** | (2006.01) |

(52) U.S. Cl.

CPC ..... *B65H 37/002* (2013.01); *B65H 2701/1942* (2013.01); *Y10S 83/922* (2013.01); *Y10S 83/923* (2013.01)

USPC ..... 156/538; 156/759; 221/73; 83/922; 83/923

(58) Field of Classification Search

CPC ..... B26D 7/06; B29C 65/50; B32B 38/10; B32B 38/18; B32B 43/006; B65H 54/86; B65H 2301/543

USPC ..... 156/538, 759; 221/73; 83/922, 923

See application file for complete search history.

(56) References Cited

FOREIGN PATENT DOCUMENTS

| | | | |
|---|---|---|---|
| JP | 07-226599 A | | 8/1995 |
| JP | 2004296982 A | * | 10/2004 |
| JP | 2006-261231 A | | 9/2006 |

OTHER PUBLICATIONS

Translation of jp2004-296982, Oct. 2004, Japan, Nagasawa.*

* cited by examiner

*Primary Examiner* — George Koch
(74) *Attorney, Agent, or Firm* — Foley & Lardner LLP

(57) ABSTRACT

In a component mounting machine including a tape feeder removing a top tape from a carrier tape of a component supply tape so as to expose a component on the carrier tape so that the component is sucked by a suction nozzle; and a waste tape collection box collecting the top tape removed from the carrier tape, a top-tape drawing member for catching and drawing out the top tape is drawably provided at a place where the top tape removed from the carrier tape is hanging down from the tape feeder into the waste tape collection box (for example, a top opening portion of the waste tape collection box).

2 Claims, 4 Drawing Sheets

COMPONENT MOUNTING MACHINE

This application claims priority from Japanese Patent Application 2010-247568, filed Nov. 4, 2010, which is incorporated herein by reference in its entirety.

BACKGROUND OF THE INVENTION

1. Field of the Invention

The present invention relates to a component mounting machine in which the work of cutting a top tape removed from a component supply tape used in a tape feeder is made easy.

2. Description of the Related Art

In a component mounting machine, conventionally, a component supply tape wound on a reel is set on a tape feeder, the component supply tape is fed to a component suction position, a component on a carrier tape of the component supply tape is exposed by removing a top tape from the carrier tape before the component suction position, the component is sucked by a suction nozzle of the component mounting machine and mounted on a circuit board, and the top tape removed before the component suction position and the carrier tape are collected in a waste tape collection box housed in a lower portion of the component mounting machine.

Further, as described in JPA-H07-226599 (Japanese Patent Application Non-Examined Publication No. H07-226599), there is a component mounting machine provided with a tape cutting mechanism disposed above the waste tape collection box so as to cut the top tape and the carrier tape removed in the tape feeder by the tape cutting mechanism to collect them in the waste tape collection box.

The top tape removed from the carrier tape is, however, a thin light film, and accordingly there is the possibility that in the course of guiding the top tape to the tape cutting mechanism through a chute or the like, static electricity or the like causes the top tape to adhere to the chute or the like, thereby preventing the top tape from being guided smoothly and, in the worst case, causing the chute or the like to be clogged with the top tape.

Therefore, there is a configuration to hang the top tape removed from the carrier tape from the tape feeder into the waste tape collection box.

This configuration, however, requires a worker to cut the top tape(s) hanging from the tape feeder with scissors or the like when the carrier tapes and the top tapes collected in the waste tape collection box are disposed of, but since a space between the tape feeder and the component mounting machine is too narrow to put a hand, scissors, or the like in therebetween (see FIG. 2), it is difficult to cut the top tape with scissors or the like.

SUMMARY OF THE INVENTION

An object of the present invention is to provide a relatively-simple configuration where the work of cutting the top tape hanging from the tape feeder into the waste tape collection box can be made easy.

In order to achieve the object, the present invention is configured to include a tape feeder feeding a component supply tape made by attaching a top tape removably on a carrier tape containing many components at predetermined pitches to a component suction position, and removing the top tape from the carrier tape before the component suction position to expose a component on the carrier tape so that the component is sucked by a suction nozzle of the component mounting machine at the component suction position; and a waste tape collection box collecting the top tape removed from the carrier tape, wherein a top-tape drawing member for catching and drawing out the top tape is provided to be capable of being drawn according to a drawing operation at a place where the top tape removed from the carrier tape is hanging down from the tape feeder into the waste tape collection box.

In this configuration, when the top tape hanging in the waste tape collection box from the tape feeder is cut with scissors or the like, the top tape hanging in the waste tape collection box can be caught and drawn out by the top-tape drawing member according to worker's operation of drawing out the top-tape drawing member, and therefore, even if a space between the tape feeder and the component mounting machine is too narrow to put the worker's hand, scissors, or the like in therebetween, the worker can cut the top tape easily with the scissors or the like after he/she performs the operation of drawing out the top-tape drawing member to draw out the top tape to a place where he/she can perform the cutting work simply. Besides, since the configuration is so simple as to provide the top-tape drawing member to be capable of being drawn according to a drawing operation, an increase in cost can be made small.

Further, it is preferred that the present invention be configured to provide the top-tape drawing member at a top opening portion of the waste tape collection box so as to be slidable in a drawing direction of the waste tape collection box. According to this configuration, the top-tape drawing member can be compactly provided to the waste tape collection box.

DESCRIPTION OF THE PREFERRED EMBODIMENT

An embodiment of the present invention will be described below.

Figure 2:
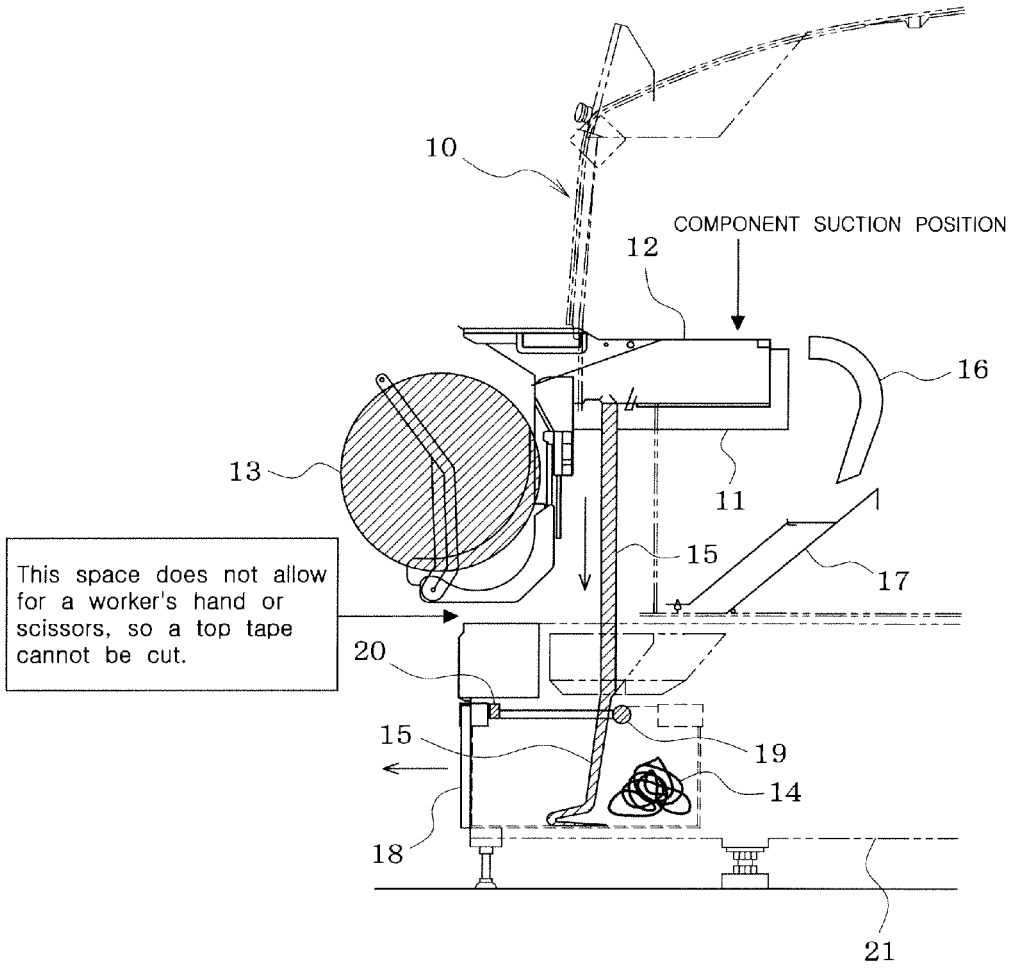
FIG. 2 is a vertical sectional side view showing that the waste tape collection box is housed in a base platform of a component mounting machine.

As shown in FIG. 2, a plurality of tape feeders 12 is set side by side on a feeder setting stand 11 of a component mounting machine 10. A reel 13 on which a component supply tape (not shown) is wound is set on the tape feeder 12, the component supply tape is fed from the reel 13 to a component suction position, a component on a carrier tape of the component supply tape is exposed by removing a top tape 15 from the carrier tape before the component suction position, and the component is sucked at the component suction position by a suction nozzle (not shown) of the component mounting machine 10 and mounted on a circuit board.

The carrier tape from which the top tape has been removed is guided from a distal end of the tape feeder 12 to a tape cutting mechanism (not shown) through a tape guide 16, and the carrier tape is cut with the tape cutting mechanism. A cut carrier tape 14 slides down a chute 17 to be collected into a waste tape collection box 18. The waste tape collection box 18 is housed in a base platform 21 under the component mounting machine 10 so as to be capable of being drawn therefrom.

Figure 1:
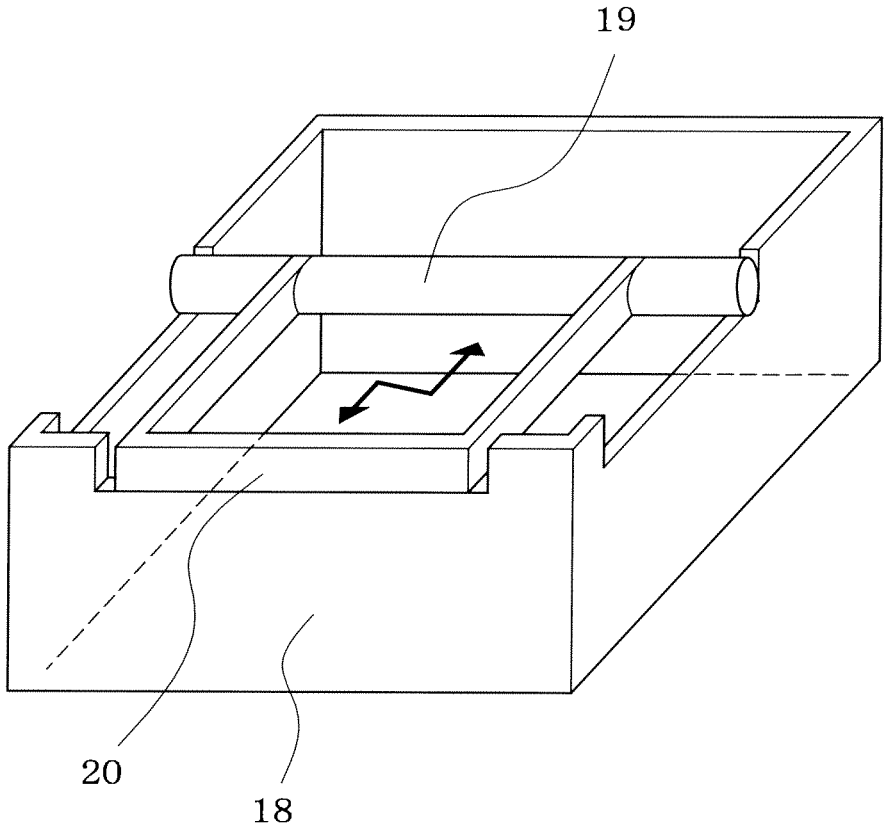
FIG. 1 is a perspective view showing a waste tape collection box with a top-tape drawing member in an embodiment of the present invention.

The top tape 15 removed from the carrier tape before the component suction position of the tape feeder 12 hangs down from the tape feeder 12 to be collected into the waste tape collection box 18 just located therebelow. As shown in FIG. 1, the waste tape collection box 18 is formed in an open-topped box shape, and a bar-shaped top-tape drawing member 19 is laid between upper-end portions of both right and left side plates of the waste tape collection box 18 so as to be slidable in a drawing direction of the waste tape collection box 18. Any structure of supporting both ends of the top-tape drawing member 19 is possible, and, for example, though not shown, both the end portions of the top-tape drawing member 19 may be configured to be slidably fitted in guide grooves formed along the upper ends of both the right and left side plates of the waste tape collection box 18. The top-tape drawing member 19 is provided with a C-shaped handle 20, and the handle 20 is located near an upper end of a front plate of the waste tape collection box 18.

As shown in FIG. 2, when the waste tape collection box 18 is housed within the base platform 21 in the lower portion of the component mounting machine 10 and the top-tape drawing member 19 is pushed into the waste tape collection box 18, the top-tape drawing member 19 is located back beyond the top tape 15 hanging in the waste tape collection box 18, and the top tape 15 is located inside the C-shaped handle 20. By pushing the waste tape collection box 18 and the top-tape drawing member 19 in a drawn-out state back to their original positions, the top tape 15 is caused to enter the waste tape collection box 18 and the top tape drawing member 19, namely, the C-shaped handle 20 without performing any special operation (handling the top tape 15 or the like).

Figure 3:
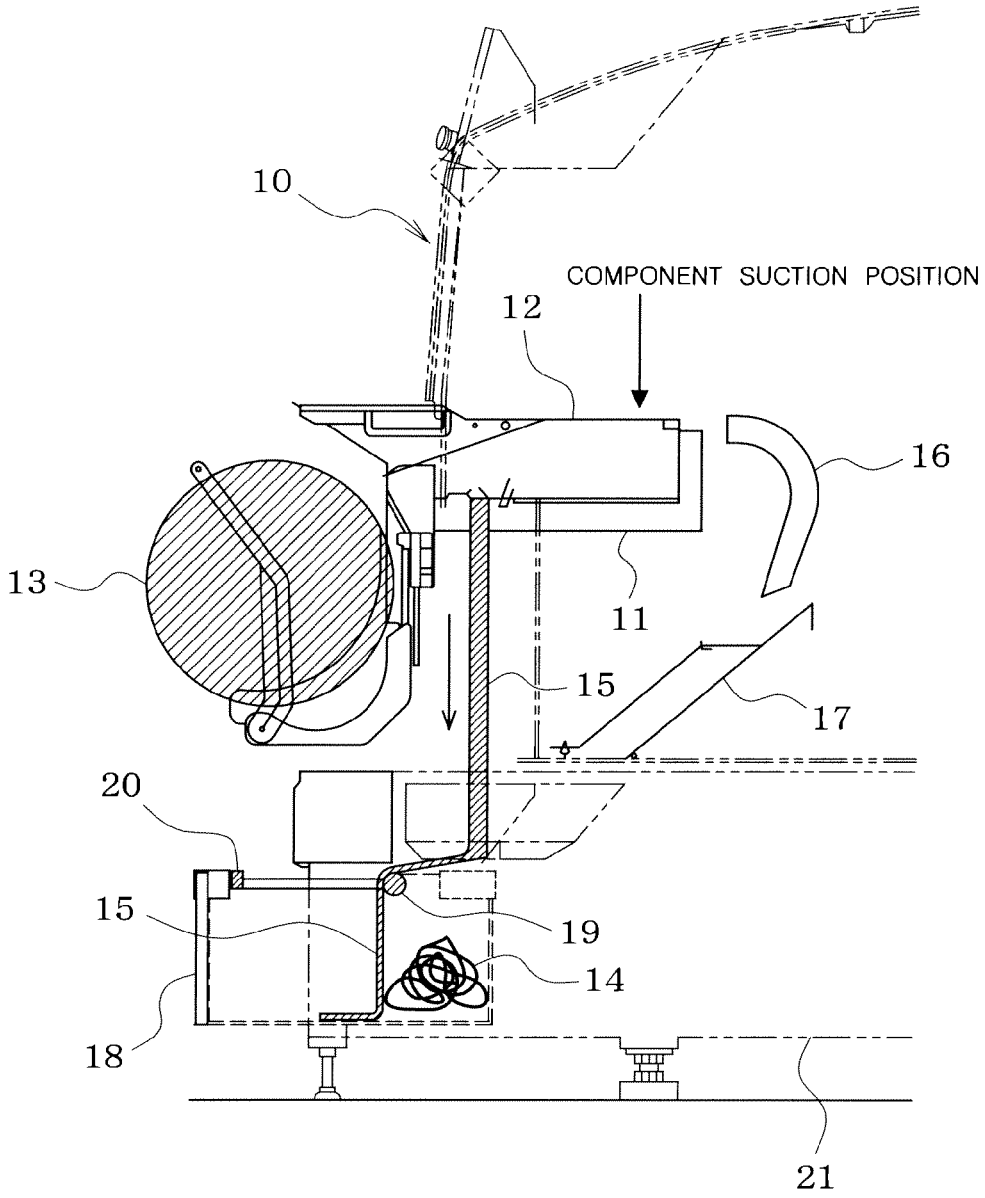
FIG. 3 is a vertical sectional side view showing that the waste tape collection box is half drawn out from the base platform of the component mounting machine.

When the top tape 15 hanging down in the waste tape collection box 18 is cut with scissors 22 or the like, first, the waste tape collection box 18 is drawn out from the base platform 21 of the component mounting machine 10, as shown in FIG. 3. At this time, a drawing amount of the waste tape collection box 18 may be, for example, half the whole drawing amount thereof, and, of course, the waste tape collection box 18 may be almost completely drawn out. Basically, it is only necessary to draw out the waste tape collection box 18 to a position in which the top tape 15 is easily cut with scissors 22 or the like.

Figure 4:
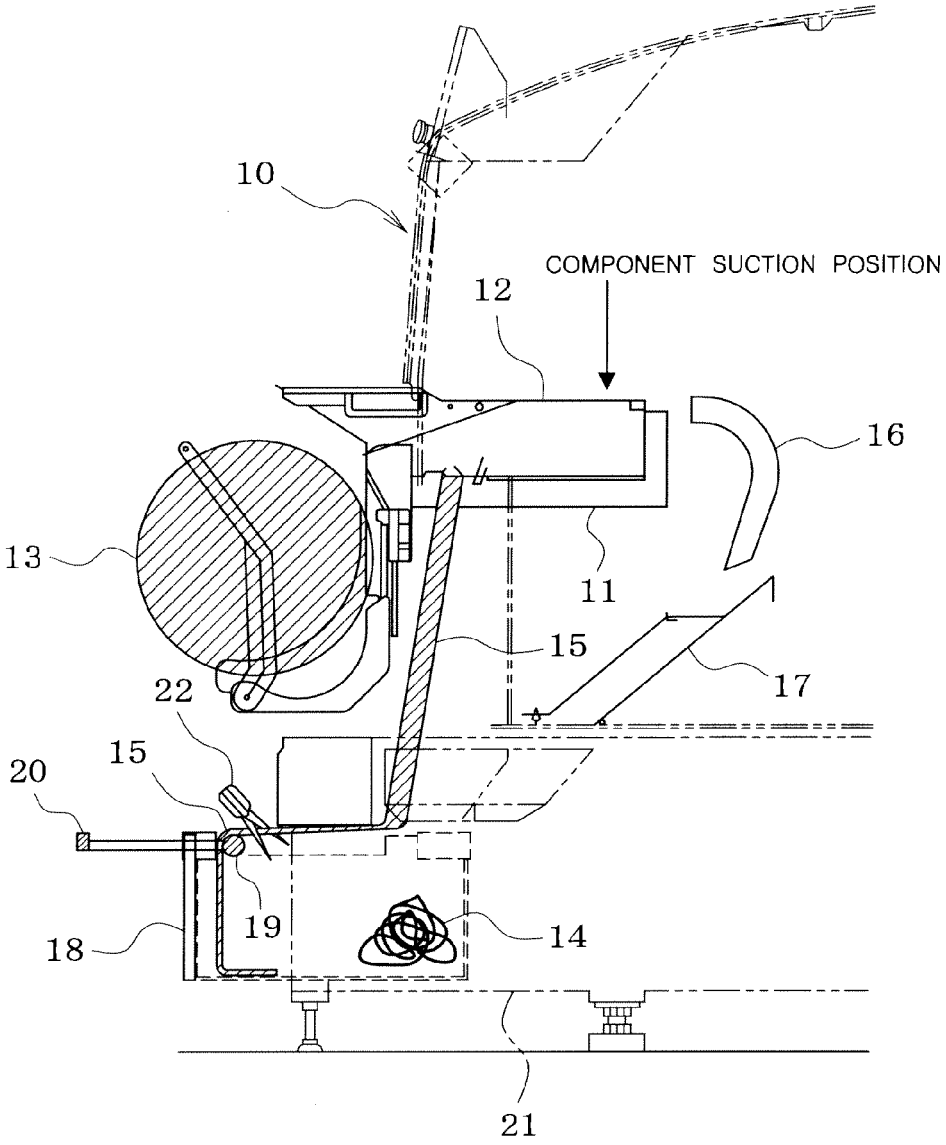
FIG. 4 is a vertical sectional side view showing that the top-tape drawing member is drawn out from the waste tape collection box half drawn out from the base platform of the component mounting machine.

Thereafter, as shown in FIG. 4, a worker grips the handle 20 and draws it toward himself/herself to draw out the top-tape drawing member 19, thereby causing the top-tape drawing member 19 to catch and draw out the top tape 15 hanging in the waste tape collection box 18. In this manner, the top tape 15 is drawn out to a position in which the top tape 15 is easily cut with the scissors 22 or the like, and the top tape 15 is cut with the scissors 22 or the like. Thereafter, the waste tape collection box 18 is almost completely drawn out, and then the top tape 15 and the carrier tape 14 are taken out of the waste tape collection box 18, and disposed of in a trash bag.

Thereafter, the worker grips the handle 20 and pushes the top-tape drawing member 19 back to an original position shown in FIG. 3, and then he/she pushes the waste tape collection box 18 back to the original position shown in FIG. 2.

Since the embodiment described above is configured to have the top-tape drawing member 19 on the top opening portion of the waste tape collection box 18 so as to be slidable in the drawing direction of the waste tape collection box 18, when the top tape 15 hanging in the waste tape collection box 18 from the tape feeder 12 is cut with the scissors 22 or the like, a worker can catch and draw out the top tape 15 hanging in the waste tape collection box 18 with the top-tape drawing member 19 according to his/her operation of drawing out the top-tape drawing member 19. Therefore, as shown in FIG. 2, even if a space between the tape feeder 12 and the component mounting machine 10 is too narrow to put his/her hand, the scissors 22, or the like in therebetween, the worker can cut the top tape 15 easily with the scissors 22 or the like after he/she performs the operation of drawing out the top-tape drawing member 19 to draw out the top tape 15 to a place where he/she can perform the cutting work simply. Besides, since the configuration is so simple as to provide the top-tape drawing member 19 at the top opening portion of the waste tape collection box 18 to be capable of being drawn according to a drawing operation, an increase in cost can be made small.

Incidentally, the mounting position of the top-tape drawing member 19 is not limited to the top opening portion of the waste tape collection box 18, and the top-tape drawing member may be provided to the component mounting machine 10 as long as the top-tape drawing member is located in a place where the top tape 15 removed from the carrier tape is hanging down from the tape feeder 12 into the waste tape collection box 18.

The present invention can be carried out in various modified forms, such as with the shape of the top-tape drawing member 19 or the providing method thereof suitably changed, without departing from the scope of the invention.

What is claimed is:

1. A component mounting machine comprising:

a plurality of tape feeders configured to feed a component supply tape made by attaching a top tape removably to a carrier tape containing a plurality of components at predetermined pitches to a component suction position, and removing the top tape from the carrier tape before the component suction position to expose each component on the carrier tape such that the component is sucked by a suction nozzle of the component mounting machine at the component suction position;

a waste tape collection box configured to collect a plurality of top tapes removed from carrier tapes of a plurality of component supply tapes set in the plurality of tape feeders and hanging down from the plurality of tape feeders;

a top-tape drawing member configured to catch and draw out the plurality of top tapes, the top-tape drawing member being drawably provided back beyond the plurality of top tapes from a position where the plurality of top tapes from the plurality of tape feeders are hanging down into the waste tape collection box; and a handle configured to draw out the top-tape drawing member, the handle being arranged on a near side beyond the plurality of top tapes hanging down into the waste tape collection box, wherein the plurality of top tapes hang down into a space surrounded by the handle and the top-tape drawing member so as to be collected in the waste tape collection box.

2. The component mounting machine according to claim 1, wherein the top-tape drawing member is provided at a top opening of the waste tape collection box so as to be slidable in a drawing direction of the waste tape collection box.

* * * * *